US005980604A

United States Patent [19]

Lavernia

[11] Patent Number: 5,980,604

[45] **Date of Patent: *Nov. 9, 1999**

[54] SPRAY FORMED MULTIFUNCTIONAL MATERIALS

[75] Inventor: Enrique J. Lavernia, Santa Ana, Calif.

[73] Assignee: The Regents of the University of California, Oakland, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/662,709

[22] Filed: Jun. 13, 1996

[51] Int. Cl.[6] ..... B22F 9/06

[52] U.S. Cl. ..... 75/338; 75/230; 75/331; 75/335; 75/338; 148/415; 148/416; 148/417; 148/418

[58] Field of Search ..... 75/337, 230, 331, 75/335, 338; 148/415, 416, 417, 418

[56] References Cited

U.S. PATENT DOCUMENTS

| | | | |
|---|---|---|---|
| 4,204,935 | 5/1980 | Klesse et al. | 204/192 |
| 4,309,159 | 1/1982 | Holic | 425/7 |
| 4,532,181 | 7/1985 | Brill et al. | 428/336 |
| 4,626,410 | 12/1986 | Miura et al. | 420/590 |
| 4,657,776 | 4/1987 | Dietrich et al. | 427/38 |
| 4,928,745 | 5/1990 | Feest et al. | 164/46 |
| 4,966,737 | 10/1990 | Werner et al. | 264/14 |
| 4,973,522 | 11/1990 | Jordan et al. | 428/614 |
| 4,978,585 | 12/1990 | Ritter et al. | 428/614 |

(List continued on next page.)

FOREIGN PATENT DOCUMENTS

| | | | |
|---|---|---|---|
| WO 89/05870 | 6/1989 | WIPO | C23C 4/12 |
| WO 94/18352 | 8/1994 | WIPO | C23C 4/12 |

OTHER PUBLICATIONS

Lavernia, et al., "Processing Maps for Reactive Atomization and Deposition Processing," Scripts Metallurgica, vol. 29, pp. 1341–1344 (1993).

Lavernia, et al., "Modeling of Reactive Atomization and Deposition Processing of Ni3A1," Acta metal. mater, vol. 42, No. 10, pp. 3277–3289 (1994).

Zeng et al., "An Experimental Investigation of Reactive Atomization and Deposition Processing of Ni3/Y203 Using N2–02 Atomization," Metallurgical Transactions, vol. 23a, pp. 3394–3399 (Dec. 1992).

Zeng et al, "Creep Behavior of Dispersion–Strengthened Ni3A1 Intermetallic Proceed Using Reactive Atomization and Deposition," Scripta Met. (1995).

"The Spray forming of Superalloys", by H.C. Fiedler, et al., Journal of Metals, Aug. 1987, pp. 28–33.

"The Structure and Properties of a Nickel–Base Superalloy Produced by Osprey Atomization–Deposition", by Rodger H. Bricknell, Metallurgical Transactions A, vol. 17A, Apr. 1986, pp. 583–591.

(List continued on next page.)

*Primary Examiner*—Patrick Ryan
*Assistant Examiner*—M. Alexander Elve
*Attorney, Agent, or Firm*—Daniel L. Dawes

[57] ABSTRACT

Spray atomization of molten metal and/or intermetallic matrix composites reinforced with ceramic particles is practiced by atomizing the matrix into micron sized droplets and depositing the semisolid droplets in a bulk deposition upon a temperature controlled substrate. The semiliquid droplets are injected with refinement particles while in a range of 0 to 40% by volume solid phase and deposited on the substrate surface while in a 40 to 90% by volume solid phase. Refined grain morphology, increased solid solubility, nonequilibrium phases, absence of macro segregation, and elimination of the need to handle fine reactive particles are all achieved by performing the spray deposition process under a controlled atmosphere. Materials fabricated by the process exhibit unusual combinations of properties, such as spatially varying properties.

37 Claims, 2 Drawing Sheets

U.S. PATENT DOCUMENTS

| | | | |
|---|---|---|---|
| 4,985,400 | 1/1991 | Choudhury | 505/1 |
| 4,988,464 | 1/1991 | Riley | 264/12 |
| 5,024,695 | 6/1991 | Ashdown et al. | 75/338 |
| 5,073,409 | 12/1991 | Anderson et al. | 427/217 |
| 5,090,997 | 2/1992 | Birkenstock et al. | 75/338 |
| 5,102,620 | 4/1992 | Watson et al. | 420/469 |
| 5,114,470 | 5/1992 | Biancaniello et al. | 75/338 |
| 5,125,574 | 6/1992 | Anderson et al. | 239/8 |
| 5,143,139 | 9/1992 | Leatham et al. | 164/46 |
| 5,147,448 | 9/1992 | Roberts et al. | 75/331 |
| 5,190,701 | 3/1993 | Larsson | 264/8 |
| 5,196,049 | 3/1993 | Coombs et al. | 75/338 |
| 5,225,004 | 7/1993 | O'Handley et al. | 148/101 |
| 5,226,948 | 7/1993 | Orme et al. | 75/331 |
| 5,228,493 | 7/1993 | Siemers et al. | 164/46 |
| 5,240,061 | 8/1993 | Watson et al. | 164/46 |
| 5,266,098 | 11/1993 | Chun et al. | 75/335 |
| 5,266,099 | 11/1993 | Kelley | 75/337 |
| 5,273,569 | 12/1993 | Gilman et al. | 75/230 |
| 5,297,613 | 3/1994 | Uebber et al. | 164/457 |
| 5,305,816 | 4/1994 | Ikawa | 164/46 |
| 5,343,926 | 9/1994 | Cheskis et al. | 164/46 |
| 5,368,657 | 11/1994 | Anderson et al. | 148/400 |
| 5,372,629 | 12/1994 | Anderson et al. | 75/332 |
| 5,390,722 | 2/1995 | Ashok et al. | 164/46 |
| 5,393,321 | 2/1995 | Eadie | 75/338 |
| 5,445,324 | 8/1995 | Berry et al. | 239/99 |

OTHER PUBLICATIONS

"Processing Effects in Spray Casting of Steel Strip", by S. Annavarapu, et al., Metallurgical Transactions A, vol. 19A, Dec. 1988, pp. 3077–3086.

"Characteristics of rapidly solidified Al–Si–X preforms produced by the Osprey process" by J.L. Estrada, et al., Journal of Materials Science, 1990, pp. 1381–1391.

"Processing and Structure of a Rapidly Solidified Mg–8.5 wt. % Li–1 wt. % Ca–1 wt. % Alloy Via Liquid Dynamic Compaction", by Ibrahim Ucok, et al., 1995, pp. 217–225.

"The effect of porosity on the microstructural damping reszponse of 6061 aluminium alloy" by J. Zhang, et al., Chapman & Hall, 1993, pp. 1515–1524.

"Damping Behavior of Particulate Reinforced 2519 A1 Metal Matrix Composites" by J. Zhang, et al., Pergamon Press Ltd., vol. 28, 1992, pp. 91–96.

"Strain Amplitude Dependence of 6061 A1/Graphite MMC Damping", by R.J. Perez et al., Pergamon Press Ltd., vol. 27, 1992, pp. 1111–1114.

SPRAY FORMED MULTIFUNCTIONAL MATERIALS

This invention was made with Government support under Grant No. 442530-22537, awarded by the Air Force Office of Sponsored Research (AFOSR). The Government has certain rights in this invention.

BACKGROUND OF THE INVENTION

1. Field of the Invention

The invention is in the field of reactive atomization and spray deposition of metal matrix composites, and in particular, relates to the control of a combination of reactive and nonreactive alloys with refinements to synthesize materials containing in-situ dispersoids.

2. Description of the Prior Art

Roberts et al., "Techniques for Producing Fine Metal Powder," U.S. Pat. No. 5,147,448 (1992), is directed to a gas atomization process for forming metal powder. Roberts discusses reactive atomization wherein the reactive phases of the material are more coarse and ductile so that they string out when deformed and act as a fiber reinforcement.

Watson et al., "Copper Alloys with Dispersed Metal Nitrides and Method of Manufacture," U.S. Pat. No. 5,102,620 (1992), describes a process using a reactive element, which is soluble in the metal alloy, reacts with the atomization atmosphere during the deposition process and provides a deposited metal matrix in which reinforcing particles are incorporated. The process is described as spray casting in a reactive atmosphere.

Werner et al., "Method and Device for Manufacturing a Powder of Amorphous Ceramic or Metallic Particles," U.S. Pat. No. 4,966,737 (1990), Kelley, "Method for Producing Closed Cell Spherical Porosity and Spray Formed Metals," U.S. Pat. No. 5,266,099 (1993); Ashok et al., Spray Cast Copper Composites," U.S. Pat. No. 5,390,722 (1995); and Gilman et al., "Magnesium Based Metal Matrix Composites Produced from Rapidly Solidified Alloys," U.S. Pat. No. 5,273,569 (1993), show systems for codeposition of materials. Kelley is directed to codeposition of metallic elements with blowing agents such as barium carbonate. Ashok describes spray casting composites wherein the first constituent may be a reactive element, and the second constituent another metal or reinforcing element such as carbon fiber. Gilman describes a composite material produced from a base metal matrix and a reinforcing phase. A dispersion of a reinforcing phase into the magnesium matrix of Gilman is described as being performed by atomization techniques.

Chun et al., "Production of Charged Uniformly Sized Metal Droplets," U.S. Pat. No. 5,266,098 (1993) and Orme et al., "Method and Apparatus for Droplet Stream Manufacturing," U.S. Pat. No. 5,226,948 (1993), both describe metal droplet deposition methods. Chun suggests utilizing a pulse gas jet oscillating at a predetermined frequency in order to provide a narrow distribution of the metal droplets in a manner compared to conventional gas atomization techniques. Orme discloses modulation of the metal droplet generators to provide a predetermined spray variation.

Dietrich et al., "CVD Process for the Production of a Superconducting Fiber Bundle," U.S. Pat. No. 4,657,776 (1987); Brill et al., "Multilayer Web for Reducing Loss of Radiant Heat," U.S. Pat. No. 4,532,181 (1985); Miura et al., "Method of Making Composite Material of Matrix Metal and Fine Metallic Particles Dispersed Therein," U.S. Pat. No. 4,626,410 (1986); Klesse et al., "Thin-Film Resistor and Process for the Production Thereof," U.S. Pat. No. 4,204,935 (1980), each describe a deposition process or composite material formation process utilizing a reactive atomization technique. Dietrich for example, describes a plasma activated chemical vapor deposition process which discloses deposition of a superconducting material on a fiber reinforcement.

Feest et al., "Metal Matrix Composite Manufacture," U.S. Pat. No. 4,928,745 (1990); Watson et al., "Substrate for Spray Cast Strip," U.S. Pat. No. 5,240,061 (1993); Leatham et al., "Spray Deposition Method and Apparatus Thereof," U.S. Pat. No. 5,143,139 (1992); and Eadie, "Method and Apparatus for Producing Strip Products by a Spray Forming Technique," U.S. Pat. No. 5,393,321 (1995), show deposition processes utilizing atomization. Although none of these references are specifically directed to reactive atomization, Leatham discloses the addition of particulates to form a composite coating which was disclosed in a copending published foreign application. Feest describes codeposition of reinforcing material particulates in the context of an atomization process. Uebber et al., "Process and Apparatus for Producing Rotationally Symmetrical Bodies," U.S. Pat. No. 5,297,613 (1994).

Anderson et al., "Method of Making Environmentally Stable Reactive Alloy Powders," U.S. Pat. No. 5,372,629 (1994); Anderson et al., "Gas Atomization Synthesis of Refractory of Intermetallic Compounds and Supersaturated Solid Solutions," U.S. Pat. No. 5,368,657 (1994); Biancaniello et al., "Producing Void-Free Metal Alloy Powders by Melting as well as Atomization Under Nitrogen Ambient," U.S. Pat. No. 5,114,470 (1992); Ashdown et al., "Fine Hollow Particles of Metals and Metal Alloys and Their Production," U.S. Pat. No. 5,024,695 (1991); Anderson et al., Environmentally Stable Metal Powders," U.S. Pat. No. 5,073,409 (1991); Choudhury, "Process for Producing Superconductive Ceramics by Atomization of Alloy Precursor Under Reactive Atmospheres or Post Annealing Under Oxygen," U.S. Pat. No. 4,985,400 (1991), each describe reactive atomization processes. Each of these references discusses the formation of a powder composition utilizing reactive atomization.

O'Handley et al., "Bulk Rapidly Solidified Magnetic Materials," U.S. Pat. No. 5,225,004 (1993), is directed generally to a system for producing powder material utilizing an atomization process, although is not necessarily a reactive atomization process. Liquid dynamic compaction is a process of direct fabrication of solid, even massive, bodies directly from a molten spray of fine, atomized liquid or semiliquid droplets. The process combines the advantages of rapid solidification with simultaneous consolidation to a final shape directly from the rapid quenched droplets while providing exposure only to the chosen atmosphere or gas used in the atomization process itself, typically, helium and argon. E. J. Lavernia, "Liquid Dynamic Compaction of a Rapidly Solidified 7075 Aluminum Alloy Modified with 1 Percent Nickel and 0.8 percent zirconium," MS Thesis 1984, MIT, Cambridge, Mass.

In the liquid dynamic compaction process during gas atomization, a stream of molten alloy is broken or shattered into a spray of fine droplets by jets of high velocity inert gas. The droplets solidify rapidly due to their large surface areas and high velocity relative to the atomizing gas and are collected in a cyclone collector at the bottom of an atomizing chamber with the particles ranging in size from a few microns to a few hundred microns. Essentially all the droplets are completely liquid and have not started to crystallize when they contact a metallic substrate surface placed beneath the atomization cone. A powder is used in the process or used in combination with inert gas such as argon or helium in a chamber and for atomization. Therefore, during the process, the pressure in the spray deposition chamber is slightly positive, for example, about 1 psig. Difficulties in dealing with reactive alloys, such as fine powders of aluminum and rare earth containing alloys, can be accommodated in practice by using an inert gas filled spray deposition chamber. The atomization cooling condition in the process is controlled so that the droplets are liquid, but undercooled or about to solidify when they contact the substrate surface. The droplets are essentially liquid and have not yet started to crystallize when they contact the metallic substrate surface. After impacting the substrate, the droplets form splats and continue to cool to temperatures well below their liquid temperature. Droplet sizes range generally from about 1 to 200 microns with the grain sizes in the deposition formed therefrom in the range of approximately 30–45 microns or greater.

None of the foregoing technologies however successfully fabricated a reactive spray atomization metal matrix composite with a low porosity. superplasticity, or a grain size generally lower than 10 microns, none successfully dealt with the inclusion of solid dispersoids into the atomized droplets, and none permitted controlled deposition products containing spatially varying physical and mechanical properties. Therefore, what is needed is an apparatus and methodology whereby such improved composites may be controllably and successfully fabricated at low cost and high reliability.

BRIEF SUMMARY OF THE INVENTION

The invention is a method for spray deposition synthesis of composite materials comprising the steps of superheating a matrix material, atomizing the superheated matrix material into a spray, and propagating the spray toward a substrate surface. At least one secondary material is injected into the spray prior to impingement of the spray on the substrate surface. Secondary material is defined as any material different than the matrix including coated particles of matrix. The secondary material is physically in the form of a particle, flake, platelet, fiber or hollow body. The secondary material is injected into the spray at a predetermined solidification condition of the atomized spray. As a result, a rapidly solidified microstructure is deposited on the substrate surface characterized by a controlled density.

In the illustrated embodiment the predetermined solidification condition is in the range of approximately 0 to 40% by volume of solid phase within the spray. The matrix is superheated and atomized into the spray. Typically, the matrix is superheated to approximately 100 to 200° K. above its melting point.

A predetermined distance is defined between where the spray is atomized and where the spray has secondary materials injected therein. The predetermined distance is are in the range of approximately 200 to 500 mm. The spray impinges upon the substrate in a predetermined solidification condition, namely approximately 40 to 100% by volume of solid phase within the spray.

A predetermined distance is established between where the spray impinges upon the substrate and wherein the spray is atomized, typically in the range of approximately 200 to 600 mm.

In one embodiment the method further comprises moving the substrate as the spray is disposed thereon to manipulate deposition characteristics of the matrix with injected secondary materials. For example, the substrate may be rotated or translated. The substrate may be continuously or intermittently rotated or translated as the spray is impinges upon the substrate.

The sprayed matrix with injected secondary materials are solidified on the substrate in a nonequilibrium condition. The matrix may be atomized with an inert or reactive gas, sprayed in an inert or reactive gas environment with or without coinjected nonreactive or reactive secondary material resulting in a final composite which is in a physical and/or chemical nonequilibrium condition.

Still further the matrix and secondary materials may be reactive with each other and are disposed on the substrate without substantial reaction during spray deposition. Alternatively, the reaction may occur prior to impingement of the droplets on the substrate, but wherein the sprayed matrix and secondary material are combined in a nonequilibrium condition so that a rapidly solidified microstructure is deposited on the substrate surface characterized by a controlled density. The secondary material is combined with the matrix droplets in a partial nonequilibrium reaction so that the secondary material is formed with a size approximately in the range of 2 microns or less in diameter when the matrix material is solidified on the substrate.

The invention is still further defined as a method for spray deposition synthesis of composite materials comprising the steps of superheating a matrix material, atomizing the superheated matrix material into a spray, propagating the spray toward a substrate surface, and injecting low density microspheres into the spray prior to impingement of the spray on the substrate surface. As a result, a rapidly solidified microstructure is deposited on the substrate surface characterized by low density and high damping.

In the illustrated embodiment the microspheres are hollow microspheres having a diameter in the range of approximately 10 to 100 microns.

In addition to microspheres the above method may be practiced by injecting reactive secondary materials into the semiliquid droplets prior to impingement of the droplets of the spray on the substrate surface to generate an in situ gas to create pores in the semiliquid droplets when the droplets solidify. The reactive secondary material decomposes under heat to produce the in situ gas.

In another embodiment of the foregoing method the porosity is controlled by supersaturating the matrix material with a soluble gas and cooling the sprayed semiliquid droplets after impingement of the droplets of the spray on the substrate surface to precipitate the soluble gas from the semiliquid droplets as the droplets solidify to create pores in the solidified matrix material. The matrix material is supersaturated with a soluble gas by bubbling the soluble gas through the matrix material when the matrix material is in a liquid form, dissolving the soluble gas in the matrix material when the matrix material is in a liquid form at a temperature elevated above the melting point of the matrix material, or pressurizing the matrix material with the soluble gas when the matrix material is in a liquid form.

The invention is still further defined as a method for spray deposition synthesis of composite materials comprising the steps of superheating a matrix material, atomizing the superheated matrix material into a spray of droplets, propagating the spray toward a fiber reinforced array disposed a substrate surface, and forming at least one secondary material in the droplets while is are propagated toward the fiber reinforced array on the substrate surface. The droplets of the spray are integrated with the at least one secondary material into the fiber reinforced array on the substrate surface. As a result, a rapidly solidified fiber reinforced microstructure is deposited on the substrate surface characterized by a controlled density.

The invention is also defined as a composition of metal matrix composites with secondary materials fabricated by any of the foregoing methodologies.

The invention may now be better visualized by turning to the following drawings wherein like elements are referenced by like numerals.

The invention and its various embodiments may now be better understood by turning to the following detailed description.

DETAILED DESCRIPTION OF THE PREFERRED EMBODIMENTS

Spray atomization of molten metal and/or intermetallic matrix composites reinforced with ceramic particles is practiced by atomizing the matrix into micron sized droplets and depositing the semisolid droplets in a bulk deposition upon a temperature controlled substrate. The semiliquid droplets are injected with refinement particles while in a range of 0 to 40% by volume solid phase and deposited on the substrate surface while in a 40 to 90% by volume solid phase. Refined grain morphology, increased solid solubility, nonequilibrium phases, absence of macro segregation, and elimination of the need to handle fine reactive particles are all achieved by performing the spray deposition process under a controlled atmosphere. Materials fabricated by the process exhibit unusual combinations of physical properties, for example, high strength and high damping, and are therefore designated herein as multifunctional materials.

Figure 1:
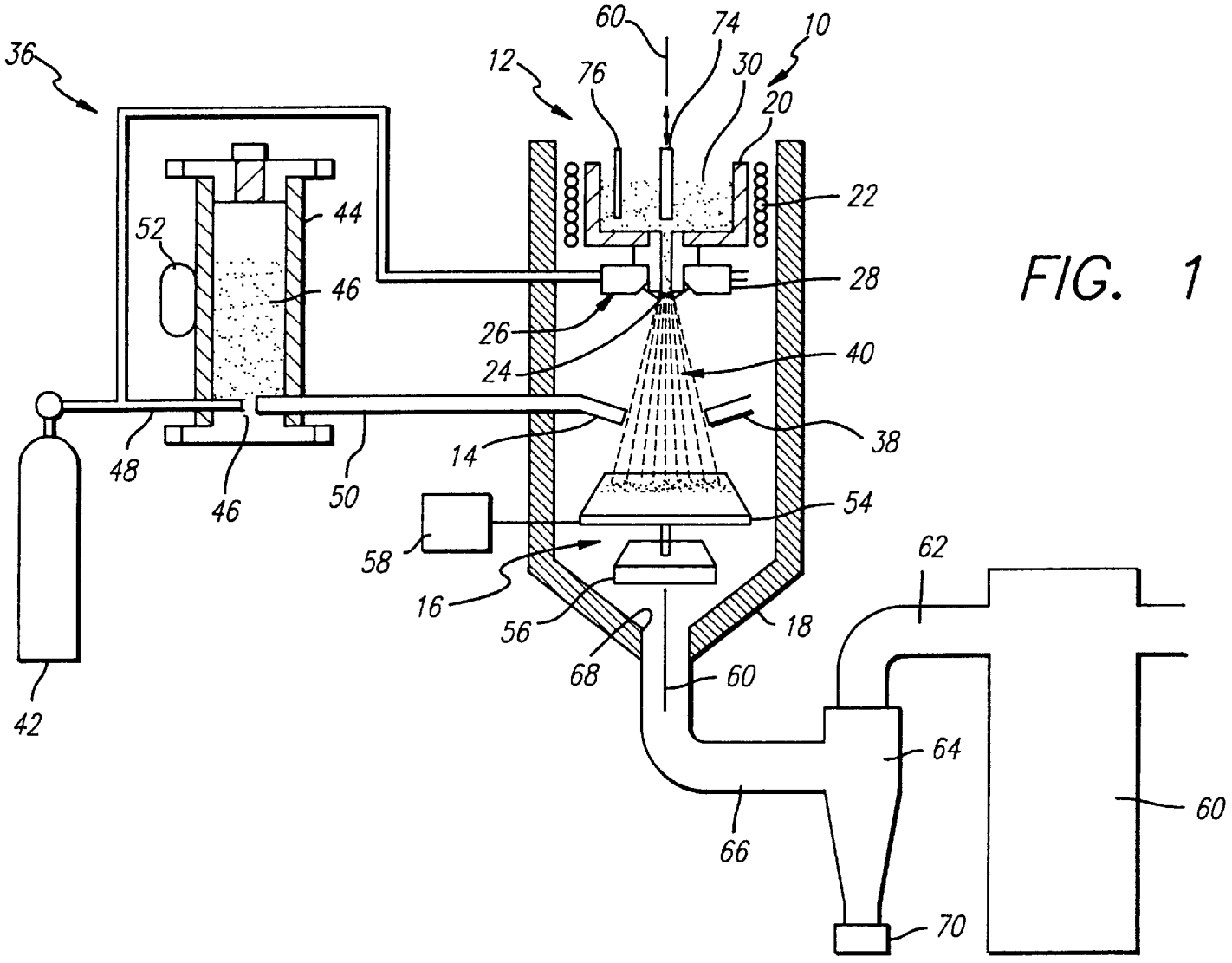
FIG. 1 is a simplified diagrammatic cross-sectional view of apparatus used for the spray deposition synthesis of metal matrix composites according to the invention.
Figure 2:
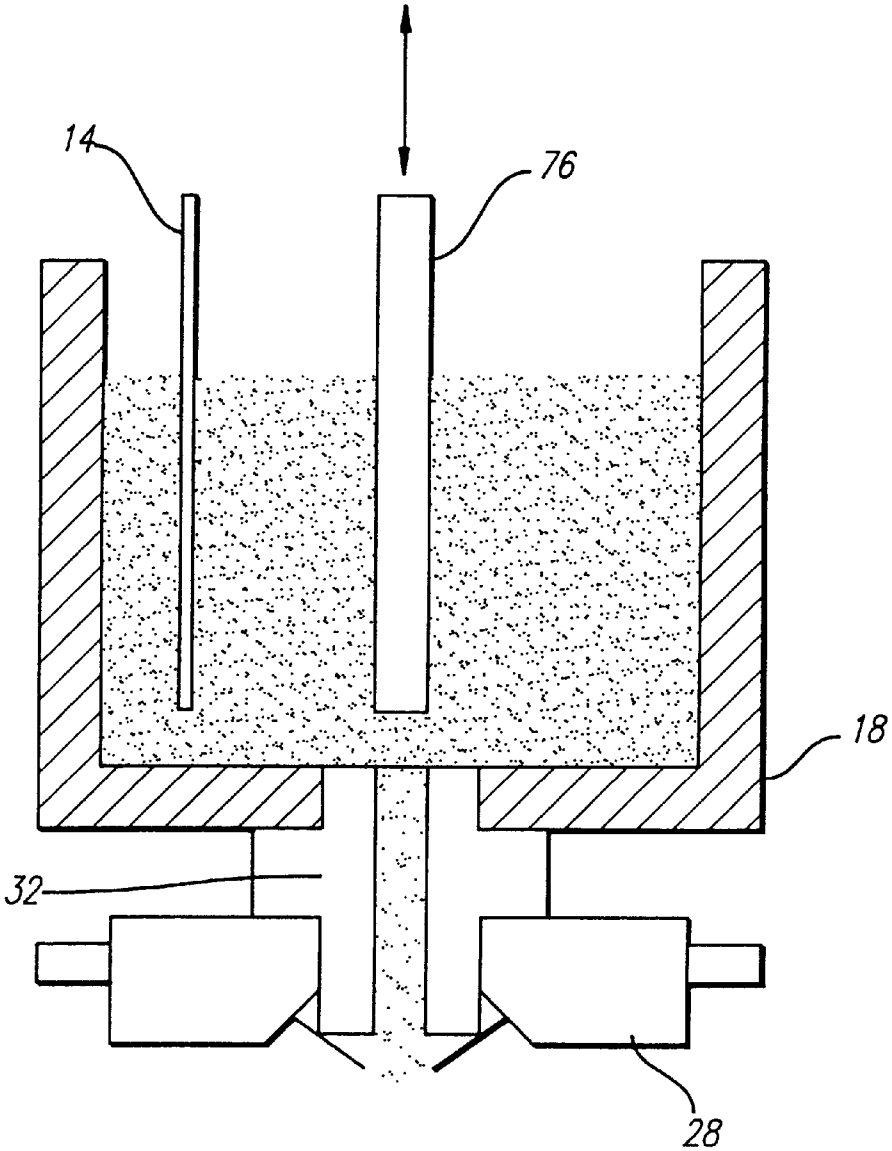
FIG. 2 is a simplified diagrammatic cross-sectional view in enlarged scale of the delivery system and atomization system used in FIG. 1.

The apparatus of FIG. 1, generally denoted by reference numeral 10, is shown in simplified and diagrammatic cross-sectional side view and is used for the spray deposition synthesis of composite and materials with spatially varying properties according to the invention. The methodology of the invention is used to synthesize any alloy with injected solids or liquids, but in particular is used for metal and intermetallic matrix composites reinforced with ceramic particles. Spray deposition synthesis of composite materials comprises three basic stages from which there may be many variations and modifications while still being within the scope of the invention. The first stage is the melting and atomization of the matrix material, the second is reinforcement coinjection, and the third is deposition of composite sprays. In reference to these three stages of the methodology, spray deposition apparatus 10 is comprised of three systems, an atomization unit, generally denoted by reference numeral 12, a reinforcement injection unit, generally denoted by reference numeral 14, and a deposition/collection unit, generally denoted by reference numeral 16. All three units, 12, 14 and 16, are enclosed within an environmental chamber 18 through which environmental control is provided as described below.

Atomization unit 12 is comprised of a melting crucible 20, a heating furnace 22, which in the illustrated embodiment is comprised of a conventional resistance or induction coil, a melt delivery system 24 provided at the bottom of crucible 20, a gas supply system 26, and an atomizer 28. Crucible 20 contains solid and melted matrix material 30 and may be comprised of material and/or coatings which are inert or substantially inert to molten matrix material 30. For example, the composition of crucible 20 may be comprised of graphite, zirconia, alumina, boron nitrite, magnesia, or a combination of these materials, or other similar materials. Any materials now known or later discovered to have physical and chemical properties for inert containment of the chosen molten matrix material 30 is within the contemplation of the invention.

Melt delivery system 24 is comprised of a shaped delivery tube or duct 32 through which molten matrix material 30 is delivered from crucible 20 to atomizer 28. The shape of duct 32 may be of any geometry desired in order to obtain a shaped or unshaped spray. In the illustrated embodiment, the preferred shapes include both cylindrical and linear shapes, namely shapes having either circular or rectangular cross sections. A cylindrical shaped duct 32 would be used to deliver a near net shape bulk material to a deposition stage as described below, while a linear shaped duct 32 would be used to deliver a sheet deposition to an underlying moving conveyor (not shown).

The constituents of material delivery system 24, like crucible 20, are comprised of materials which are inert or substantially inert to molten matrix 30 and include materials such as graphite, alumina and boron nitride. The inner diameter 34 of duct 32 in the case that it has a circular cross section, or in the case of a linear rectangular delivery slot, the thickness or small dimension of the slot, is approximately in the range of 2.0 to 7.5 mm. The nozzle length of duct 32 is determined according to the desired aspiration pressure at the nozzle exit according to conventional design principles. Again, in the illustrated embodiment, the preferred aspiration pressures are from $-3\times10^{-3}$ to $3\times10^{-2}$ MPa. Atomizer 28 is also correspondingly circular or slot-shaped in order to be close coupled to duct 32 according to its shape, and is otherwise conventional in design.

Reinforcement coinjection unit 14 is comprised of a gas supply 26, a reinforcing phase entrainment system 36 and a plurality of injector nozzles 38. In the illustrated embodiment, four injector nozzles 38 are used within environmental chamber 18 and are disposed about longitudinal axis 60 of chamber 18 out of spray cone 40 and directed at an arbitrary angle relative to the direction of propagation of atomization cone 40. For example, in the illustrated embodiment four nozzles 36 are disposed symmetrically about cone 40 and are directed approximately perpendicularly into cone 40. The typical injection pressure used in injectors 38 is in the range of approximately 100 to 100 psig and are selected based upon the functional dependence of both the reinforcement mass flow rate and the reinforcement velocity on the injection pressure according to the teachings of the invention. For example, an injector pressure on the order of 100 psig leads to injection velocities of 25–150 m/sec.

Reinforcement mass flow rate is defined as the mass per unit time ejected by each nozzle 38 into atomization cone 40, while reinforcement velocity is defined as the velocity of the injected particles emitted at the exit orifices of nozzles 38. The reinforcement velocity determines the degree of penetration of the injected particles, which are solid particles, into the liquid or semi-liquid droplets which comprise atomization cone 40. The mass flow rate will determine the result into volume fraction of the injected solid particles into the droplet. For example, under injection conditions of 25–150 psig particulate volume fractions in the range of 1 to 40% can be achieved.

Reinforcement phase entrainment system 36 entrains the reinforcements or solid particles, which will be injected into the droplets by means of high pressure injection gas from gas supply 42. Injectors 14 accelerate direct the reinforcement particles into atomization cone 40. As shown in FIG. 1, reinforcement phase entrainment system 36 is comprised of a particulate container 44 in which reinforcement particles 46 are contained and fed to an entrainment gap 46 between a gas delivery tube 48 and an inlet tube 50 coupled to injectors 14. Particles 46 are continually fed into gap 46 by means of gravity feed within container 44 in combination with a mechanical agitator 52.

Deposition/collection unit 16 comprises a deposition substrate 54 and a motion control system 56. Deposition substrate 54 is a metallic or ceramic surface onto which the molten droplets with the impregnated reinforcements are collected. Substrate 54 is temperature controlled by heating and cooling elements, diagrammatically depicted as heating/cooling source 58. Motion control system 56 controls the motion of deposition substrate 54 in three dimensional space including rotation at least around the longitudinal axis 60 of environmental chamber 18 and/or translation within the X-Y perpendicular cross sectional plane through environmental chamber 18. The deposition materials typically build up upon substrate 54 in a Gaussian distribution of particle size as may be modified by the shape of atomization cone 40 defined by duct 32. Basic shapes or fills into molds, jigs, or the like, can thus be manipulated by means of both rotation and translation of substrate 54 during deposition of the composite matrix material, either on a continuous basis or on a discrete sequential basis, where, for example, the deposition means may be translated for a selected period of time from one position on a mold or jig to another. Therefore, it is contemplated as within the scope of the invention that vertical displacements three axes rotation may be employed continuously or selectively in time as may be desired.

Apparatus 10 is further arranged and configured to be operated either in a atmospheric, flushed gas, or reactive environment. In the preferred embodiment, environmental chamber 18 is evacuated as shown in FIG. 1 by a vacuum pump system 60. Vacuum pump system 60 may include mechanical pumps, ion or diffusion pumps, although in the illustrated embodiment, partial pressure levels of 0.2 to 0.3 Torr have been found to be usually sufficient, so that only mechanical pumping is required. Cyclone separator 64 in turn has its inlet pipe 66 coupled to a bottom outlet orifice 68 of chamber 18. Stray reinforcements and droplets, typically of very small size, which for any reason may not be collected on substrate 54, are separated by cyclone separator 64 and collected in a powder collector 70 to thereby avoid damage and contamination to vacuum pumping system 60.

The apparatus 10 of FIG. 1 now having been generally described, consider the methodology of spray deposition for the synthesis of composite materials. Prior to melting and spray deposition, chamber 18 is first evacuated before heating of the matrix to about 0.2 to 0.3 Torr, and then filled with an inert gas to a pressure of 0.1 to 0.2 MPa. For lower vapor pressure materials, when the temperature within crucible 22 reaches 150 to 250° C., vacuum pump 60 is turned off and inert gas is backfilled into chamber 18 to pressure of about 1 to 5 psi. The objective of this step is to remove the absorbed water vapor from the charge in surrounding insulation. Once this step is completed, charge is heated up to the melting point.

Once the charge is melted, heating continues until a predetermined amount of super heat is achieved and maintained for a period of time, for example, from 15 minutes to an hour to ensure homogeneity of the melt. Vacuum is again applied by vacuum pump 60 and ideally maintained constant during deposition. The matrix material 30, a metal, alloy and a metallic, which has previously been placed inside crucible 20, is then heated and melted using either resistance or induction heating. The melt is superheated prior to its atomization typically to a temperature of approximately 100 to 200° K. above the melting or liquidous temperature of the primary matrix material. The melt, which pulls at the bottom of crucible 20, is delivered into atomizer 28 by material delivery system 26 described above. A lined orifice 72 disposed above duct 32 can be selectively closed and opened by means of a nonreactive stopper rod 74 to prevent delivery prior to the superheated state. The temperature of matrix melt 30 at the bottom of crucible 20 is monitored by means of a thermocouple 76. When the superheated temperature described above is reached, rod 74 is withdrawn and the molten matrix flows into duct 32 and is thereafter atomized through the use of an inert gas. The diameter of delivery duct 32 ranges from 0.1 to 0.15 inch with the nozzle length determined to promote an aspiration pressure of −0.5 to −1.7 psi, the tip of delivery duct 32.

The melt is disintegrated into a dispersion of fine micron-sized droplets using high pressure inert gas such as argon, nitrogen or helium supplied from gas supply 42. Atomization occurs in atomizer 28 as the melt exits delivery system 26. Typically, atomization pressure is in the range of 0.7 to 7 MPa or between 150 to 350 psi. The mass ratio of the gas-to-melt flow rate in atomizer 28 is preferably in the range of 0.1 to 1. After the droplets have been atomized and travel through the evacuate chamber 18 and impinge upon substrate 54 to form a deposit, the vacuum level within chamber 18 drops quickly at the beginning of the atomization but then stabilizes, for example, at about 10 to 30 Torr, until the process is complete.

In reinforcement coinjection stage 14, the injection gas is also selected to be inert with respect to the material composing the droplets in atomization cone 40. Again, nitrogen or argon gas may be employed as the injection gas. This is not to exclude, however, the possibility of using reactive gases to coinject the particles. The injection gas pressure is in the range of 0.07 to 0.7 MPa and the injection distance, which is the vertical distance between atomizer 28 and the reinforcement injection position of injector nozzles 38, is variably selected based upon the solidification condition of the atomized spray. In the preferred embodiment, this reinforcement-to-atomization distance is in the range of 500 to 200 mm, at which point, the droplets in atomization cone 40 typically are in the range of 0 to 40 percent by volume in the solid phase with the remainder in liquid phase. The volume and distribution of reinforcements in the resulting solid preform described below is controlled by controlling the injection pressure of the reinforcements from reinforcing phase entrainment system 36 and reinforcement coinjection stage 14.

In deposition unit 16, the atomized droplets, which are now interdispersed with reinforcements, arrive in a semiliquid form and impact deposition table 54. The droplets that impinge initially on substrate surface 54 and thereafter on top of each other form and weld together to form a coherent preform. The deposition distance, that is the distance between atomizer 28 and substrate surface 54, is selected so that the atomized spray will contain approximately in the range of 40 to 90 percent by volume solid phase at the time the droplets impinge upon substrate 54. The precise value of the solid phase volume depends upon the material being disposed. The typical distances between atomizer 28 and substrate 54 is in the range of 200 to 600 mm.

The dimensions and morphology of the preform is controlled by motion of substrate 54. In the case where substrate 54 is rotating, rational speeds typically in the range of 0 to 150 rpm are selected. In case of translation, substrate 54 is generally translated at a linear velocity in the range of 0 to 40 mm/sec. Typically, a four or five pound deposit of aluminum alloy can be fabricated in 80 to 150 seconds.

Composites with spatially varying properties can be synthesized by periodically injecting reinforcements during the spray deposition. Typically, the frequency of injection is between 0 to 10 injection cycles per minute in layered composites. In addition, functionally graded materials can be synthesized by changing the rate of reinforcement injection continuously during the spray deposition. For example, a periodic gradient in the preform can be obtained by periodically modulating the injection of refinements. In either case, when reinforcement injection is occurring, typical flow rates of reinforcement is in the range of 0.1 to 50 grams per second.

The apparatus and methodology now having been described, turn and consider the composition of material which is obtained by practicing the method within the apparatus described. The above-described method and apparatus produces bulk materials with uniformly refined microstructures in a cost effective, energetically economic and environmentally clean manner. In comparison with other conventional processing, such as casting of powder or metallurgy, spray atomization deposition techniques as described above result in materials having a refined grain morphology, increased solid solubility, nonequilibrium alloys in compositions, absence of macro segregations, near net shape forms, low cost, the elimination of the need to handle fine reactive powders, the ability to process metal matrix composites, and the ability to form composites in a reactive atomization deposition system.

The physical and mechanical properties fabricated according to the method are significantly better than those of materials produced by conventional methods. For example, the creep properties (elevated temperatures) of oxide dispersion and strengthened materials produced using this approach are superior to those which do not contain oxide dispersions. Moreover, metal and intermetallic composites with superior damping and elastic modulus are produce by the present method.

Because the spray deposition may be accomplished in a reactive atmosphere, whole new classes of reactive materials can be produced which would otherwise be impractical or impossible.

The material formed by the process also exhibit marked superplasticity. Superplasticity is the ability of material to exhibit a large amount of deformation, for example, as much as 3 to 10 times the original length, before catastrophic failure at temperature points above half the melting temperature of the material. Superplastic formation is thus an economic and attractive manufacturing alternative to common machine processes for forming metallic objects, because of its potential to achieve near net-shaped forming. However, to be structurally superplastic, the grain size must be fine, stable and equiaxial. Typically, only materials with very small grain size, generally less than 10 microns, exhibits such superplasticity.

The grain size in most of the spray deposit materials of the prior art is generally in the range of 20 to 50 microns. Therefore, the challenge has been to achieve superplasticity in spray deposit material with grain sizes of less than 10 microns. Conventionally processed materials, such as cast alloys, exhibit a grain size of over 100 microns but spray deposit materials commonly exhibit grain sizes less than 50 microns.

In order for aluminum alloys to achieve superplasticity, it is necessary to form the alloy using a three-step process of spray atomization deposition, incorporation of secondary phases, and thermomechanical processing. The incorporation of secondary phases is carried out by any one of three techniques, such as in-situ dispersoids using reactive atomization deposition as described above, direct addition of zirconium or addition of fine ceramic particles. Consider for example incorporation of secondary phases using reactive atomization and deposition (RAD) processing of a 5083 aluminum alloy. 5083 aluminum alloys having zirconium additions and RAD processing exhibit grain sizes between 15 to 25 microns. Spray deposited 5083 aluminum with 0.6% directly added zirconium for example, exhibits an average grain size of about 11.4 microns in the as-sprayed deposited conditions. Application of thermochemical processing such as hot extrusion with multiple pass warm rolling further reduces grain size to less than 5 microns. Superplasticity tests show the spray deposition processed 5083 aluminum with 0.6 percent zirconium exhibit an elongation of 191% at 530° C. with a strain rate of about $10^{-3}$. A peak elongation value of 465% is observed for 5083 aluminum with 0.6% zirconium alloy at a strain rate of $3\times10^{-5}$ at 550° C. RAD processed 5083 aluminum exhibits an elongation of 185% at 530° C. with a strain rate of approximately $10^{-3}$.

Spray deposition has further been used to fabricate silicon carbide particulate reinforced 5182 aluminum metal matrix composites. Microstructural examination reveals there is a uniform distribution of silicon carbide particles in a refined grain morphology in 5182 aluminum combined with 1.2 micron silicon carbide particles. Superplasticity tests show that the 5182 aluminum with silicon carbide spray deposition particles exhibits elongation of over 40% at 538° C. during a multistrain test ranging in strain rates from $10^{-3}$ to 10.

The reactive atomization deposition of the invention combines atomization, reaction, and consolidation into a single step process to synthesize oxide-dispersion-strengthened systems and other dispersion-strengthened materials. The synthesis offers the opportunity for in situ, continuous control over alloy composition and chemical reaction between atomized droplets and reactive atomization gas. By carefully selecting alloy addition and reactive gas combinations on basis of thermodynamic considerations, it is possible to use the approach of the invention to synthesize materials containing in situ dispersoids, such as carbides, nitrides and oxides.

An example of one reactive system according to the invention may be helpful in understanding the nature and dynamics of reactive spray deposition of the invention. Consider $Ni_3Al$ as a intermetallic compound. Pure nickel and aluminum with an atomic ratio of the 3-to-1 is placed in a zirconium crucible and 0.02 percent by weight boron added to form $Ni_2B$ to improve room temperature ductility. Also 1-to-2 percent by weight Y was added to enhance the activity of the alloy. The Ni—Al—B—Y mixture is melted under a nitrogen atmosphere up to a maximum temperature of 1600 to 1650° C. where it was held for 10 minutes. The molten alloy is then delivered to an atomizer as shown in FIG. 1, using a ceramic delivery tube wherein the mixture is atomized using nitrogen or a nitrogen-oxygen gas mixtures.

Oxygen is added in this example in the proportion of 5, 15 and 35 percent by weight although any percentages may be used according to the teachings of the invention. The atomized droplets were subsequently deposed on water cooled copper substrate 54.

X-ray diffraction analysis confirms the presence of the $Ni_3Al$ intermetallic compound with traces of $Al_2O_3$ and $Ni_2Y$ observed in materials atomized using mixtures of nitrogen and 5 percent by weight oxygen and nitrogen with 15 percent by weight oxygen. A significant amount of nickel and a small amount of NiO phase was observed material atomized using a nitrogen and 35 percent by weight oxygen.

The results of thermal stability studies reveals that grain size of material atomized with the nitrogen and nitrogen-5% oxygen mixtures increased with increasing annealing time at 1200° C. The grain size of material atomized with a nitrogen-15% oxygen mixture, however remained relatively unchanged under the annealing conditions. This behavior is thought to be due to the large volume fraction of oxide dispersoids present in the material.

Bright and dark field transmission electron microscope (TEM) micrographs reveals $Y_2O_3$, $Al_2O_3$ and $Ni_2Y$ through selective area diffraction analysis. Qualitative analysis reveals the volume fraction of oxide particles increased with increasing content of the oxygen in the nitrogen/oxygen atomizing gas. Most of the oxide particulates observed during the TEM analysis exhibited a spheroidal morphology and their sizes ranged from a few nanometers to approximately 0.1 micron. The oxide particles were both present intragranularly as well as transgranularly. Scanning electron microscopy shows the presence of a $Ni_3Al$ intrametallic matrix and a secondary nickel-rich disordered phase as a secondary phase. A number of reactions are possible as listed below and the predicted favored reaction is to produce $Y_2O_3$ as thermodynamically the most stable oxide.

$$Ni+1/2O_2=NiO$$

$$2Al+3/2O_2=Al_2O_3$$

$$3NiO+2Al=3Ni+Al_2O_3$$

$$2Y+3/2O_2=Y_2O_3$$

$$3NiO+2Y=3Ni+Y_2O_3$$

The X-ray analysis however reveals trace amounts of $Al_2O_3$ materials atomized using a mixture of nitrogen and 5% by weight oxygen and nitrogen with 15% by weight oxygen. A small amount of NiO was present in materials atomized using a mixture of nitrogen and 35% by weight oxygen. It is possible that Y atoms did not have sufficient time to diffuse to the surface and react with oxygen, hence oxidation of aluminum dominated the reaction.

Chemical analysis results shows that the total amount of Y present in the materials was only 30% of the nominal composition. This phenomena may be attributable to reactions between Y in the melt and the ceramic crucible. The oxygen contents results show that total amount of oxygen in the materials atomized with nitrogen/oxygen mixtures of 5% and 15% by weight range from 0.15 to 0.20 percentage by weight. The total amount of oxygen present in materials atomized with nitrogen and 35% by weight oxygen mixtures was however 2.38% by weight. It is worth noting however that the material prepared using this 35% oxygen mixture was so thin and porous that the measured amount of oxygen might not be indicative of the actual oxygen content in the material.

The oxygen content of the atomization gas critically influences the microstructure of the materials, possible due to the altering of the heat transfer characteristics of the atomized droplets. The cooling rates experienced by the overspray powders depend upon the oxygen content present in the atomization gas. The grain size of the reactive materials increased with increasing oxygen content consistent with the cooling rate results. The low thermal conductivity of the oxide films formed on the surface of the droplets during atomization is thought to be partly responsible for this observed trend. The thermal conductivity of Ni, $Ni_3Al$ and Al are 4 to 20 times higher than those corresponding to the oxide phases. Comparison of the magnitude of the thermal energy that is released during the relevant exothermic reactions to the latent heat of fusion suggest that any increase in temperature experienced by the droplets during reaction is not sufficient to account for the observed reduction in cooling rate.

To obtain high volume fraction of evenly distributed oxide particles on reactive materials, it would be desirable for oxidation reactions to occur evenly throughout each droplet, that is both internal/external oxidation instead of oxidizing primarily in the droplet surface. However, on the basis of thermodynamic considerations, internal oxidation of a single droplet is only possible when the partial pressure of oxygen is lower than $6\times10^{-9}$ atmospheres. Hence, in the view of relatively high concentration of oxygen used in the gas mixture as described above, as well as the relatively short flight time of the droplets, it is most likely that the external oxidation dominates the ensuing reactions. Fortunately, even if the surface oxidation dominates the reaction of the droplets, the violent impact of the partially solidified droplets during deposition leads to the formation of a relatively homogeneous distribution of oxide particles in the materials.

There are five possible mechanisms to explain the kinetics of the reactions of droplet with its surrounding gas, namely: (1) mass transfer of oxygen in boundary layer surrounding the droplets; (2) adsorption of oxygen atoms at the surface of the droplets; (3) mass transfer of oxygen through the oxide film; (4) selective chemical reaction of oxygen with reactive elements; and (5) mass transfer of oxygen into the droplet.

To compare the mass transfer of oxygen the boundary with internal diffusion in the droplet, the Biot number for mass transfer may be used as below:

$$B_i=k_d d/D_l$$

where d is the diameter of the droplet, $D_l$ is the diffusivity of oxygen in the droplet, and $k_d$ is the convective mass transfer coefficient of oxygen estimated using the Sherwood number for a single spherical particle:

$$N_{sh}=k_d d/D_g=2.0+0.60(V_r d/v)^{1/2}(v/D_g)^{1/3}$$

where $D_g$ is the diffusivity of oxygen in gas phase, $V_r$ is the relative velocity and v is the viscosity of the gas mixture. The mass mean diameter, d, is measured to be about 60 microns. The magnitudes of the viscosity of the gas mixture and diffusivity of oxygen in the gas mixture is assumed to be 0.132 $cm^2$/sec and 0.178 $cm^2$/sec, respectively. The mean relative velocity of 133 m/sec was adopted as a basis for experimental numerical results. Accordingly the value of the Sherwood number and $K_d d$ is calculated to be 15.35 and 2.73 $cm^2$/sec, respectively. The Biot numbers are calculated thus to be $3.42\times10^6$ and $5.25\times10^9$ using $D_1$ equal to $8\times10^{7}$ $cm^2$/sec for internal diffusion and $D_1$ equal $5.2\times10^{-20}$ $cm^2$/sec for diffusion through the oxide film, respectively. Therefore, the mass transfer through the boundary layer should be much faster than diffusion inside the droplet and diffusion through the oxide film.

The diffusivity of oxygen through aluminum oxide is $5.2\times10^{20}$ $cm^2$/sec and that of aluminum through aluminum oxide is $3.3\times10^{-20}$ $cm^2$/sec at 1200° C. By simply comparing these data with the diffusivity of oxygen and $Ni_3Al$, which is $8\times10^{-7}$ $cm^2$/sec, it is clear that the mass transfer through the oxide film is slower than the mass transfer inside the droplet. Hence, it appears oxides behave as a diffusion barrier on the surface of the droplet.

Mass transfer through the oxide film is therefore the limiting step for the formation of oxide particles during reactive processing. The time spent by an average size droplet from the point of atomization to the point of impact is milliseconds so there may be no oxide film formed or the oxide film may be discontinuous. In this case, the rate of chemical reaction instead of diffusion is the rate limiting step. The results suggest therefore that the reactive processing methodology may be effectively used to synthesize metallic matrices containing a distribution of fine oxide particles.

The fabrication of fiber reinforced metal matrix composites and intermetallic matrix composites by means of liquid metal infiltration, plasma spray and stacked fiber/foil processing is well known. Each of these processes have advantages as well as limitations which dictate the ultimate application for the fabricated composites. For example, deleterious intermediate phases can form between the fiber and matrix in certain composite systems when exposed to elevated temperatures for significant time periods, such as those that are associated with liquid metal infiltration. Plasma spray form continuously reinforced composites, and yield products which have excellent properties and broad diversity of fiber/matrix combinations, but the high cost of these materials limits their use to a very specialized application. Stack fiber/foil composite materials are limited by the choice of fiber/matrix combinations due to the diffusion reactions that are associated with processing. Moreover, material must be available in foil form. Fabrication of these types of composites tends to be very labor intensive, making them impractical for many applications.

The present invention deals with using spray atomization and deposition to fabricate intermetallic or metal composites reinforced with a network of fibers. In spray atomization deposition a stream of molten metal is disintegrated to a fine dispersion of droplets using high energy inert gasses. The resulting Gaussian distribution of micronsized semisolid droplets is directed toward a substrate, where they impact and build up in a preform of predetermined microstructure and geometry. Directing the spray onto a network of continuous fibers allows the formation of continuously reinforced composite materials. This type of approach has the advantage of avoiding or minimizing reactions with the reinforcement phase, is applicable to most fiber/matrix systems and can produce materials which have fine, nonsegregated structures, exhibit good mechanical properties and are economical to make. What has been previously disclosed however is the use of conventional spray atomization onto stainless steel or molybdenum wires in a conventional inert gas-filled spray deposition chamber.

The use of spray deposition according to the invention may be extended to a fiber reinforced array disposed on the substrate surface 54 shown in FIG. 1. A secondary material may be included in the spray deposition droplets, which are propagated into the fiber reinforced array on substrate 54 by injecting the secondary material into the droplets at a predetermined solidification condition of the droplets. It is anticipated that the fiber reinforced array will have a structure open enough to permit integration of the droplets into the array and hence may tend to have a fiber density lower than the highest fiber densities that are encountered in conventional fiber matrices.

The secondary material may be reactively formed in the droplets prior to integration of the droplets of the spray into the fiber reinforced array in the substrate. Still further, droplets may be integrated with the secondary material into the fiber reinforced array in the substrate while still in a nonequilibrium condition.

Ultralight material based on enhanced internal pore microstructure allows significant weight and cost reduction as well as high damping, good thermal insulation and high impact and crush resistance. Light weight, high strength materials enable such advantages as a 50 to 70% improvement in vehicle fuel efficiency by 30 to 50% reduction of weight without sacrificing size, safety or comfort of the vehicle design.

Conventional processing methods have limited the success of producing the porous metal and alloys. The control of internal pore size, and volume fraction distribution have been difficult problems to solve. The spray deposition methodology of the invention provides low cost processing of super light metals and alloys with a controlled internal microstructure. The resulting product is a reactive light metal super-alloy and a composite with controlled porosity.

As before, a spray of molten metal droplets is generated using the high energy atomization gas as described above in connection with FIG. 1. Spray 40 of metal droplets is directed toward substrate 54 impinges upon a deposition surface and builds up into a preform of predetermined dimensions. High rates of solidification are achieved as a result of rapid heat extraction during atomization deposition. The effective cooling rate may be achieved in spray deposition is of the order of $10^3$ to $10^4$ K/sec which is several orders of magnitude higher than realized in conventional ingot casting. When compared to rapid solidification powder metallurgy (RS/PM) methods, spray deposition produces materials of similar properties as RS/PM, but with a reduced number of processing steps and the possibility of near net-shape manufacturing. Furthermore, spray deposition is a process that potentially allows low volume manufacturing costs comparable to high volume production.

Ultralight weight in the material is achieved by generating pores in the microstructure. The pore size, size, distribution, pore morphology and interconnectivity is controlled according to the invention as described below. In addition to greater controllability over the generation of porosity, the above methodology is provides near net shape manufacturing of ultralight weight porous metals and alloys. For example, it is contemplated that a controlled porous microstructure is obtained by the present invention through: 1) tandem spray deposition; 2) reactive spray deposition; and 3) spray codeposition of microspheres. Porosities of greater than 40% are anticipated as achievable. Further, the methodology of the invention may combine one or more of these approaches, such a reactive spray with microsphere coinjection.

First consider the coinjection of microspheres. The method of spraying coinjection microspheres defines the porosity by introduction of coinjected hollow microspheres into the metal matrix during the spray deposition process. The secondary material 46 of FIG. 1 is thus hollow microspheres instead of particulate material. The metal matrix as before is melted and disintegrated into a fine dispersion of micron-sized droplets using high velocity inert gas jets generated by atomizer 28. The spray of droplets 40 is then directed onto substrate 54 or into a shaped container, spray mold or jig. Hollow ceramic microspheres may be injected into the spray at various flight distances by means of nozzles 14 and 38. Following coinjection of the mierospheres, a mixture of rapidly quenched partially solidified droplets with interdispersed hollow microspheres is deposited into a coherent preform, the shape of which may be controlled by selecting different substrates, containers or by controlling substrate motion.

Hollow ceramics microspheres are commercially available in the size of 10 to 100 microns with a wall thickness of several microns. Such microspheres have been used in polymeric matrix composites to reduce density and improve strength.

In addition to providing ultra light weight, there are several unique features in the microsphere reinforced low porosity composite. These features include: controllability of porosity content and pore size; possibility of synthesized layered and functionally graded composite structures with controlled spatial pore distribution; and the possibility of near net shape forming. The amount of and size of the pores may be preselected by controlling the amount and size of the microspheres coinjected. Layered, functionally graded pore structures can thus be generated by modulating microsphere coinjection rates as a function of time. Furthermore, it is possible to coinject different size microspheres at different points and times to obtain further types of graded porous structures.

In the case of reactive spray deposition by coinjected reactive particles, secondary material 46 is comprised of solid particles that react with metal matrix or are reactive under the thermal conditions of the spray deposition. The matrix materials are maintained in a semisolid condition and the solid coinjected particles react with the semiliquid matrix or decompose during deposition and release gas phases. Pores are produced by the expansion of the released gas and the resultant deformation of the semiliquid matrix. Pore size and volume fraction of gas pores is controlled by reaction and solidification kinetics. Reactive spray deposition thus makes is possible to synthesize near net shape, layered or functionally graded pore structures in a manner similar to that exercise in connection with microspheres. For example, one secondary material which may be used is $BaCO_3$ which decomposes to BaO and $CO_2$. Pores will be generated by expansion of the carbon dioxide in the semiliquid matrix.

In the case of tandem spray deposition, gas pores are generated by expansion of gases entrapped in the liquid phase during spray deposition. Most metallic materials dissolve a certain amount of gas in both liquid and solid states. The solubility of gases, however, depends to a great extent on the temperature of the material, its physical state, i.e. whether it is liquid or solid, and the environmental pressure. Examples of gas solution in metal can be found in the solubility of nitrogen in iron and hydrogen in titanium. In both the liquid and solid states, the solubility of nitrogen in iron decreases with decreasing temperature. Moreover, the solubility in the solid phase is much less than in the liquid phase. In this case, a significant portion of the dissolved nitrogen is released when supersaturated liquid iron cools and solidifies. This type of phenomena is typically present in metallic materials.

The particular mechanism used in the invention introduces gas pores through spray deposition as follows. The starting material is melted and supersaturated with soluble gasses. Supersaturation is accomplished by one or more approaches used singularly or in combination. Such methods include: bubbling the soluble gas into the liquid melt; increasing the liquid temperature in the presence of the soluble gas; and/or pressurizing the liquid melt with gasses. The metal which is supersaturated with gasses is subsequently atomized into droplets and deposited in the shape preform as described in connection with FIG. 1. The solidification condition of the droplet deposition on the substrate is controlled such that the droplets contain both liquid and solid phases. Since a large proportion of gases are released when the solidification proceeds, pores are formed by the nucleation and growth of such gases thus making the spray deposited mass porous. The volume fraction of gas pores is controlled by controlling the amount of supersaturatred gas in the super-heated liquid prior to atomization. This technique also provides a possibility of near net shape forming.

It is further to be understood that these three approaches may be used in conjunction or in combination with each other as desired according to the invention. In each case, what results is porous materials with controlled pore size, size distribution, volume fraction spatial distribution, that is layering of porous structures and functionally graded porous structures.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

I claim:

1. A method for spray deposition synthesis of composite materials comprising:

superheating a matrix material;

atomizing said superheated matrix material into a spray of droplets;

propagating said spray toward a substrate surface; and injecting at least one secondary material into said spray prior to impingement of said spray on said substrate surface, wherein said secondary material is injected into said spray when a predetermined solidification condition has been achieved in said droplets of said atomized spray, whereby, a rapidly solidified microstructure is deposited on said substrate surface characterized by a controlled density.

2. The method of claim 1 wherein said predetermined solidification condition is in the range of approximately 0 to 40% by volume of solid phase within said spray.

3. The method of claim 1 wherein said matrix is superheated to approximately 100 to 200° K. above its melting point.

4. The method of claim 1 wherein a predetermined distance is defined between where said spray is atomized and where said spray has secondary materials injected therein, said predetermined distance being in the range of approximately 200 to 500 mm.

5. The method of claim 1 wherein said droplets of said spray impinge upon said substrate in a predetermined solidification condition.

6. The method of claim 5 wherein said predetermined solidification condition of said droplets of said spray when impinging on said substrate is approximately 40 to 100% by volume of solid phase within said droplets.

7. The method of claim 6 wherein a predetermined distance is established between where said spray impinges upon said substrate and wherein said spray is atomized, said predetermined distance being in the range of approximately 200 to 600 mm.

8. The method of claim 1 further comprising moving said substrate as said spray is disposed on said substrate to manipulate deposition characteristics of said matrix with injected secondary materials.

9. The method of claim 1 wherein said sprayed matrix with injected secondary materials are solidified on said substrate in a nonequilibrium condition.

10. The method of claim 1 wherein said matrix and secondary materials are reactive and are disposed on said substrate without substantial reaction during spray deposition.

11. A method for spray deposition synthesis of composite materials comprising:

superheating a matrix material;

atomizing said superheated matrix material into a spray;

propagating said spray toward a substrate surface; and injecting at least one secondary material into said spray prior to impingement of said spray on said substrate surface, wherein said secondary material is injected into said spray at a predetermined solidification condition of said atomized spray, and where said spray impinges upon said substrate in a predetermined solidification condition, whereby, a rapidly solidified microstructure is deposited on said substrate surface characterized by a controlled density.

12. The method of claim 11 wherein said predetermined solidification condition of said droplets of said spray when impinging on said substrate is approximately 40 to 100% by volume of solid phase within said droplets.

13. A method for spray deposition synthesis of composite materials comprising:

superheating a matrix material;

atomizing said superheated matrix material into a spray;

propagating said spray toward a substrate surface; and injecting at least one secondary material into said spray prior to impingement of said spray on said substrate surface, wherein said secondary material is injected into said spray at a predetermined solidification condition of said atomized spray, and where said spray impinges upon said substrate in a predetermined solidification condition, wherein a predetermined distance is established between where said spray impinges upon said substrate and wherein said spray is atomized, said predetermined distance being in the range of approximately 200 to 600 mm, whereby, a rapidly solidified microstructure is deposited on said substrate surface characterized by a controlled density.

14. A method for spray deposition synthesis of composite materials comprising:

superheating a matrix material;

atomizing said superheated matrix material into a spray of droplets;

propagating said spray toward a substrate surface;

injecting at least one secondary material into said droplets of said spray prior to impingement of said spray on said substrate surface, wherein said secondary material is injected into said spray at a predetermined solidification condition of said atomized spray; and solidifying said sprayed matrix with injected secondary material on said substrate in a nonequilibrium condition, whereby, a rapidly solidified microstructure is deposited on said substrate surface characterized by a controlled density.

15. The method of claim 14 where propagating said spray toward a substrate surface is performed in an inert gas.

16. The method of claim 14 where said spray deposition is performed in a reactive gas.

17. The method of claim 16 where propagating said spray toward a substrate surface is performed in a reactive gas environment.

18. The method of claim 16 where atomizing said superheated matrix material is performed with a reactive gas.

19. The method of claim 16 where injecting said at least one secondary material is performed with a reactive gas.

20. The method of claim 14 where solidifying said sprayed matrix with injected secondary material on said substrate in a nonequilibrium condition solidifies said sprayed matrix with injected secondary material in physical nonequilibrium with each other.

21. The method of claim 14 where solidifying said sprayed matrix with injected secondary material on said substrate in a nonequilibrium condition solidifies said sprayed matrix with injected secondary material in chemical nonequilibrium with each other.

22. A method for spray deposition synthesis of composite materials comprising:

superheating a matrix material;

atomizing said superheated matrix material into a spray of droplets using a reactive gas selected to form a target phase;

propagating said spray toward a substrate surface; and reactively forming at least one secondary material in said droplets of said spray prior to impingement of said droplets on said substrate surface, wherein said sprayed matrix and secondary material are combined and solidified in a nonequilibrium condition, whereby, a rapidly solidified microstructure is deposited on said substrate surface characterized by a controlled density.

23. The method of claim 22 where propagating said spray toward a substrate surface is performed in an inert gas.

24. The method of claim 22 where said spray deposition is performed in a reactive gas.

25. The method of claim 22 where propagating said spray toward a substrate surface is performed in a reactive gas environment.

26. The method of claim 22 where atomizing said superheated matrix material is performed with a reactive gas.

27. The method of claim 22 where injecting said at least one secondary material is performed with a reactive gas.

28. The method of claim 22 where combining said sprayed matrix with secondary material on said substrate in a nonequilibrium condition combines said sprayed matrix with said secondary material in physical nonequilibrium with each other.

29. The method of claim 22 where combining said sprayed matrix with secondary material on said substrate in a nonequilibrium condition combines said sprayed matrix with said secondary material in chemical nonequilibrium with each other.

30. The method of claim 22 where reactively forming said at least one secondary material comprises forming said at least one secondary material by a partial nonequilibrium reaction so that said secondary material is formed with a size approximately in the range 2 microns or less in diameter when said matrix material is solidified on said substrate.

31. The method of claim 30 where forming said at least one secondary material by a partial nonequilibrium reaction comprises injecting reactive gas into said propagating spray.

32. A method for spray deposition synthesis of composite materials comprising:

superheating a matrix material;

atomizing said superheated matrix material into a spray of droplets;

propagating said spray toward a substrate surface; and injecting low density microspheres into said droplets of spray prior to impingement of said droplets on said substrate surface, whereby, a rapidly solidified microstructure is deposited on said substrate surface characterized by low density and high damping.

33. The method of claim 32 where injecting low density microspheres into said spray prior to impingement of said spray on said substrate surface comprises injecting hollow microspheres.

34. The method of claim 33 where injecting hollow microspheres comprises injecting hollow ceramic microspheres having a diameter in the range of approximately 10 to 100 microns.

35. A method for spray deposition synthesis of composite materials comprising:

superheating a matrix material;

atomizing said superheated matrix material into a spray of droplets;

propagating said spray toward a fiber reinforced array;

forming at least one secondary material in said droplets while being propagated toward said fiber reinforced array; and integrating said droplets of said spray with said at least one secondary material into said fiber reinforced array, where forming said at least one secondary material comprises injecting said droplets with said at least one secondary material into said fiber reinforced array in a predetermined solidification condition, whereby a rapidly solidified fiber reinforced microstructure is deposited characterized by a controlled density.

36. A method for spray deposition synthesis of composite materials comprising:

superheating a matrix material;

atomizing said superheated matrix material into a spray of droplets;

propagating said spray toward a fiber reinforced array;

forming at least one secondary material in said droplets while being propagated toward said fiber reinforced array; and integrating said droplets of said spray with said at least one secondary material into said fiber reinforced array, where forming said at least one secondary material comprises integrating said droplets of spray in a predetermined solidification condition with injected secondary material into said fiber reinforced array in a nonequilibrium condition, whereby a rapidly solidified fiber reinforced microstructure is deposited characterized by a controlled density.

37. A method for spray deposition synthesis of composite materials comprising:

superheating a matrix material;

atomizing said superheated matrix material into a spray of droplets using a reactive gas selected to form a target phase;

propagating said spray toward a fiber reinforced array;

forming at least one secondary material in said droplets while being propagated toward said fiber reinforced array; and integrating said droplets of said spray with said at least one secondary material into said fiber reinforced array, where forming said at least one secondary material comprises reactively forming said secondary material in said droplets of said spray prior to integration of said droplets of said spray into said fiber reinforced array, and wherein said at least one secondary material is combined with said matrix material in a nonequilibrium condition, whereby a rapidly solidified fiber reinforced microstructure is deposited characterized by a controlled density.

* * * * *